US007293547B2

(12) United States Patent
Ibrahim

(10) Patent No.: US 7,293,547 B2
(45) Date of Patent: Nov. 13, 2007

(54) FUEL INJECTION SYSTEM INCLUDING A FLOW CONTROL VALVE SEPARATE FROM A FUEL INJECTOR

(75) Inventor: Daniel R. Ibrahim, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/242,173

(22) Filed: Oct. 3, 2005

(65) Prior Publication Data

US 2007/0074703 A1 Apr. 5, 2007

(51) Int. Cl.
*F02M 57/02* (2006.01)
*F02M 57/00* (2006.01)

(52) U.S. Cl. ..... 123/446; 123/456

(58) Field of Classification Search ..... 123/446, 123/447, 456, 478, 476, 497, 495, 514; 239/88–92; 417/225, 226, 227
See application file for complete search history.

(56) References Cited

U.S. PATENT DOCUMENTS

| | | | | |
|---|---|---|---|---|
| 4,069,800 | A | 1/1978 | Kanda et al. | |
| 4,372,272 | A * | 2/1983 | Walter et al. | 123/467 |
| 4,603,671 | A | 8/1986 | Yoshinaga et al. | |
| 5,299,919 | A | 4/1994 | Paul et al. | |
| 5,622,152 | A | 4/1997 | Ishida | |
| 5,931,139 | A | 8/1999 | Mack | |
| 6,113,000 | A | 9/2000 | Tian | |
| 6,453,875 | B1 * | 9/2002 | Mahr et al. | 123/446 |
| 6,513,497 | B1 | 2/2003 | Mahr et al. | |
| 6,655,355 | B2 | 12/2003 | Kropp et al. | |
| 6,868,831 | B2 * | 3/2005 | Lei | 123/467 |
| 6,880,527 | B2 * | 4/2005 | Magel | 123/467 |
| 2002/0053340 | A1 * | 5/2002 | Lei | 123/446 |
| 2004/0003794 | A1 * | 1/2004 | Mahr et al. | 123/447 |
| 2006/0090734 | A1 * | 5/2006 | Magel | 123/446 |
| 2006/0150954 | A1 * | 7/2006 | Moore | 123/446 |

FOREIGN PATENT DOCUMENTS

WO WO 2004/005700 A1 1/2004

OTHER PUBLICATIONS

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany at the 21st International Engine Symposium, May 4-5, 2000, Vienna, Austria.

* cited by examiner

*Primary Examiner*—Mahmoud Gimie
(74) *Attorney, Agent, or Firm*—Liell +McNeil

(57) ABSTRACT

Often there is a limited fuel injector spatial envelope above and within a cylinder head for a fuel injector. In order to fit a fuel injector with a direct control needle valve and a capability of injecting fuel at a rail pressure and an intensified pressure into the limited fuel injector spatial envelope, the present disclosure includes a fuel injection system in which a pressure intensifier and nozzle outlets of a fuel injector are fluidly connected to a source of fuel via an intensifier line and an injector line, respectively. The flow of fuel to the pressure intensifier is controlled via a valve attached to the source of fuel.

11 Claims, 1 Drawing Sheet

FUEL INJECTION SYSTEM INCLUDING A FLOW CONTROL VALVE SEPARATE FROM A FUEL INJECTOR

TECHNICAL FIELD

The present disclosure relates generally to fuel injection systems, and more specifically to a method of accommodating a limited fuel injector spatial envelope within an engine system.

BACKGROUND

Engineers are constantly seeking ways to reduce undesirable engine emissions. One strategy is to seek ways to improve performance of fuel injection systems. Over the years, engineers have come to learn that engine emissions can be a significant function of injection timing, the number of injections, injection quantities and rate shapes. A fuel injection system with a variety of capabilities to produce a variety of injection strategies can better perform and reduce emissions at all engine operating conditions than a fuel injection system limited in its control over injection timing, number, quantity and rate shapes. Further, increases in the ability to vary injection rates, injection numbers, injection quantities and rate shapes can lead to more research on, and discovery of, improved injection strategies at different operating conditions.

One apparent attempt to provide a fuel injection system that can quickly vary the pressure of injections is disclosed in U.S. Pat. No. 6,453,875 B1, issued to Mahr et. al. on Sep. 24, 2002. The Mahr fuel injection system includes a common rail and a directly controlled fuel injector that has the ability to inject medium pressure fuel directly from the rail, or utilize the fuel common rail to pressure intensify fuel within the injectors for injection at relatively high pressures. Fuel can flow from the common rail to the fuel injector via a pressure line. The fuel can either flow through a valve to act upon the pressure intensifier to inject at an intensified pressure, or bypass the valve, and be injected into an engine cylinder at rail pressure. The valve controlling the flow of fuel to the pressure intensifier is incorporated within the pressure intensifier, which may or may not be included in the fuel injector itself.

Although the Mahr fuel injection system can vary the pressure of injections, the fuel injector can consume valuable space adjacent and within a cylinder head. Because the fuel being directly injected in the cylinder and the fuel actuating the pressure intensifier flow from the same source, i.e, the fuel common rail, the fuel acting on the pressure intensifier is at rail pressure, which is generally greater than the pressure of other hydraulic fluid, such as oil, that can be used to actuator the pressure intensifier. For instance, the pressure of the fuel can be three to four times greater than the pressure of oil in an oil-actuated pressure intensifier. Thus, the fuel-actuated fuel injectors, such as the Mahr fuel injector, must be sufficiently sized and sealed in order to withstand the high fuel pressure. Because there is a limited spatial envelope around and within the cylinder head for the fuel injector, the design and capabilities of the fuel-actuated fuel injector may be limited by spacial constraints. In other words, some engine systems simply do not have a spacial envelope that can accommodate the fuel-over-fuel intensified system of the type described in Mahr.

The present disclosure is directed at overcoming one of more of the problems set forth above.

SUMMARY OF THE DISCLOSURE

A fuel injection system includes at least one fuel source fluidly connectable to a fuel injector including a pressure intensifier via an injector line and an intensifier line. A valve that includes a moveable valve member within a valve body is positioned within the intensifier line and is attached to the at least one source of fuel. When the valve member is in a first position, the intensifier line is open to the fuel source, and when the valve member is in a second position, the intensifier line is blocked from the fuel source.

In another aspect, an engine includes an engine housing to which a fuel injection system including at least one fuel source is attached. The fuel source is fluidly connectable to a fuel injector that includes a pressure intensifier via an intensifier line and an injector line. A valve that includes a moveable valve member within a valve body is positioned within the intensifier line and is attached to the fuel source. When the valve member is in a first position, the intensifier line is open to the fuel source. When the valve member in a second position, the intensifier line is closed to the fuel source.

In yet another aspect, there is a method of accommodating a limited fuel injector spatial envelope for a fuel injector with a direct control needle valve and that is operable to inject fuel at a rail pressure and an intensified pressure. A pressure intensifier and a nozzle outlet of the fuel injector are fluidly connectable to at least one source of fuel via an intensifier line and an injector line, respectively. The flow of fuel to the pressure intensifier is controlled via a valve attached to the at least one source of fuel.

DETAILED DESCRIPTION

Figure 1:
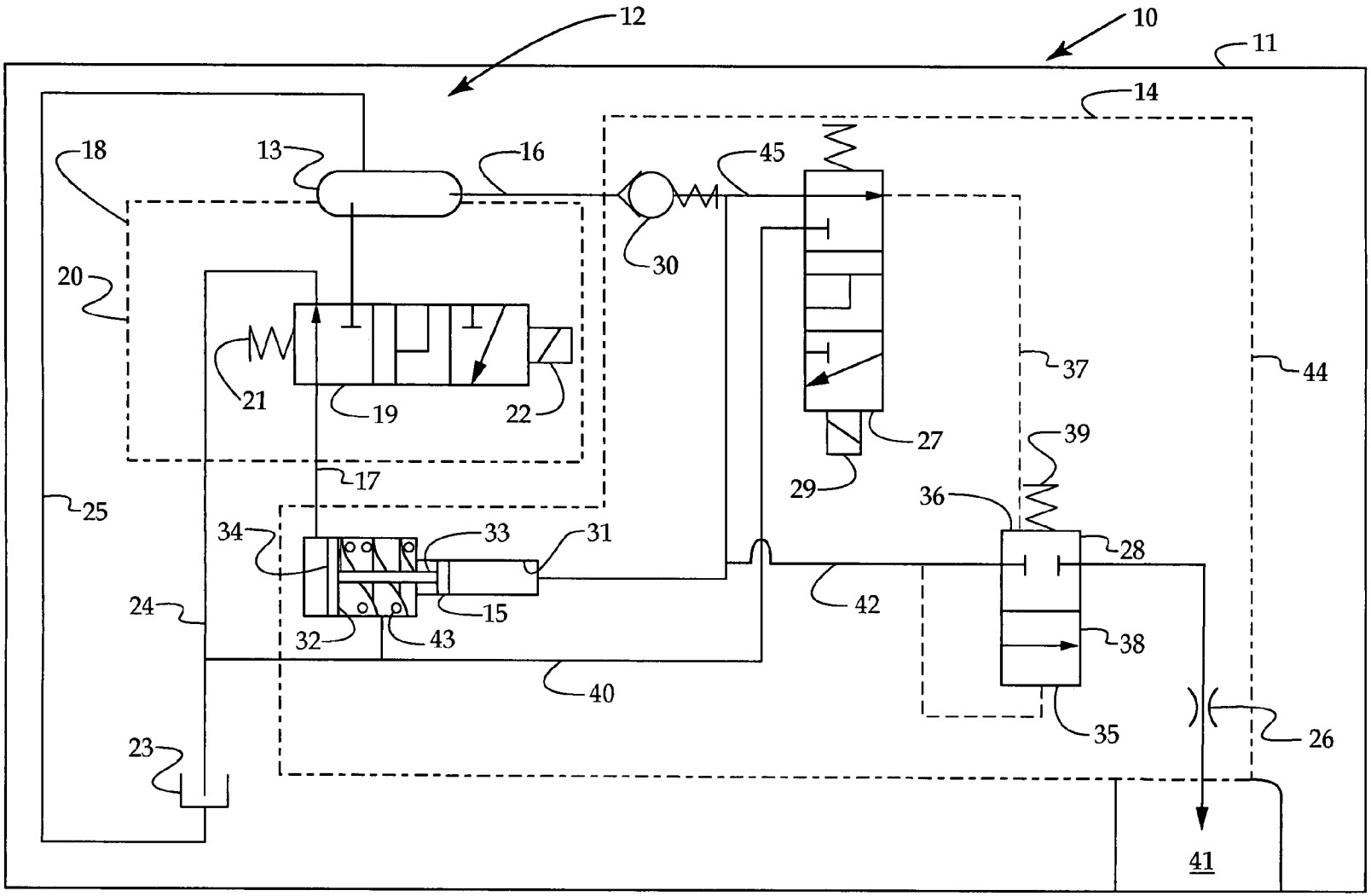
FIG. 1 is a schematic representation of an engine, according to the present disclosure.

Referring to FIG. 1, there is shown a schematic representation of a diesel engine 10, according to the present disclosure. The engine 10 includes an engine housing 11 to which a fuel injection system 12 is attached. The fuel injection system 12 includes at least one fuel source, preferably a pressurized fuel common rail 13. Fuel is pumped from a fuel reservoir 23 to the pressurized fuel common rail 13 through a supply line 25. Those skilled in the art will appreciate that at least one pump that can transfer and pressurize the fuel, in addition to at least one fuel filter, will generally be positioned within the supply line 25. The pressurized fuel common rail 13 is also fluidly connectable to a fuel injector 14 that includes a pressure intensifier 15 via an injector line 16 and an intensifier line 17. An injector body 44 defines nozzle outlets 26 through which the fuel can be injected into an engine cylinder 41. The pressure intensifier 15 is fluidly connectable to the fuel reservoir 23 via a low pressure drain 24. Although only one fuel injector 14 is illustrated in FIG. 1, the pressurized fuel common rail 13 is preferably fluidly connected to a plurality of fuel injectors. Those skilled in the art will appreciate that each fuel injector within the plurality will operate similarly to the illustrated fuel injector 14.

The fuel injection system 12 also includes a flow control valve 18 that includes a moveable valve member 19 within a valve body 20 attached to the pressurized fuel common rail 13. The valve body 20 is positioned within the intensifier line 17, and thus, the flow control valve 18 controls the flow of fuel to and from the pressure intensifier 15. Although only one flow control valve 18 is illustrated, the fuel injection system 12 preferably includes a plurality of flow control valves (one for each fuel injector), all of which operate similarly to the illustrated flow control valve 18. Those skilled in the art will appreciate that each flow control valve will control the flow of fuel to and from the pressure intensifier in each fuel injector. Although the present disclosure contemplates various types of valves, including, but not limited, to a spool valve, the flow control valve 18 is preferably a three-way poppet valve operably coupled to a first electrical actuator 22 that could be of various types, such as a solenoid subassembly, a piezo, a voice coil, etc. The poppet valve is better able to prevent leakage around the valve member from the pressurized fuel common rail 13 than a spool valve structure. When the valve member 19 is in a first position, the intensifier line 17 is open to the pressurized fuel common rail 13, and preferably, blocked from the low pressure drain 24. When the valve member 19 is in a second position (as shown), the intensifier line 17 is blocked from the pressurized fuel common rail 13, and preferably, opened to the low pressure drain 24. The valve member 19 is biased by a spring 21 to the illustrated second position. The middle valve position is merely included to illustrate valve member 19 being a poppet valve member.

The pressure intensifier 15 includes an intensifier piston 32 that is moveably positioned within the injector body 44 and includes a piston hydraulic surface 34 that is exposed to hydraulic pressure within the intensifier line 17. The intensifier piston 32 is biased toward a retracted position by a biasing spring 43. A plunger 33 is also movably positioned in the injector body 44 and moves in a corresponding manner with the intensifier piston 32. When the flow control valve 18 attached to the pressurized fuel common rail 13 fluidly connects the intensifier line 17 to the pressure intensifier 15, the pressurized fuel acts on the piston hydraulic surface 34 to move the piston 32, and plunger 33, to increase the pressure of the fuel within a fuel pressurization chamber 31 that is fluidly connected to the injector line 16. A check valve 30 is positioned within the injector line 16 to ensure that the advancing piston 32 does not push fuel back toward the pressurized fuel common rail 13. The advancing plunger 33 will increase the pressure of the fuel within the fuel pressurization chamber 31 to a pressure greater than the fuel within the pressurized fuel common rail 13. When the flow control valve 18 fluidly connects the pressure intensifier 15 to the low pressure drain 24, the low pressure acting on the piston hydraulic surface 34 will allow the intensifier piston 34 and plunger 32 to return to the retracted position under the action of biasing spring 43 and/or fuel pressure acting on the plunger. As the intensifier piston 34 and plunger 32 retract, fuel can again be drawn into the fuel pressurization chamber 31. The fuel pressurization chamber 31 is fluidly connectable to the nozzle outlets 26 via a nozzle supply passage 42.

The fuel injector 14 includes a direct control needle valve 28 and a needle control valve 27. The direct control needle valve 28 controls the fuel injection by opening and closing nozzle outlets 26 defined by the injector body 44. The direct control needle valve 28 includes a needle valve member 38 that includes an opening hydraulic surface 35 exposed to hydraulic pressure in a nozzle supply passage 42 and a closing hydraulic surface 36 exposed to hydraulic pressure in a needle control chamber 37. The nozzle supply passage 42 is fluidly connected to the injector line 16. The needle valve member 38 is biased by a spring 39 to its closed position (as shown), blocking the injector line 16 from the nozzle outlets 26.

The needle control valve 27 controls the pressure of fuel in the needle control chamber 37. In the illustrated example, the needle control valve 27 is a three way poppet valve, although it should be appreciated that the needle control valve 27 could be any type of valve that can withstand the fuel pressure, including, but not limited to, a spool valve. In addition, the disclosure also contemplates two way direct needle control via valve that opens and closes a needle control chamber to drain, as in Mahr discussed earlier. The needle control valve 27 is operable, in a first position, to raise the pressure within the needle control chamber 37 by fluidly connecting the needle control chamber 37 with the injector line 16 via a high pressure passage 45 and disconnecting the same from drain 40. When in a second position, the needle control valve 27 is operable to lower the pressure within the needle control chamber 37 by fluidly connecting the needle control chamber 37 with the low pressure drain 24 via a low pressure passage 40 and disconnecting the same from high pressure passage 45. The needle control valve 27 is biased to its first position (as shown), and includes a second electrical actuator 29 that could be of various types, such as a solenoid subassembly, a piezo, a voice coil, etc. A middle valve position is shown to indicate a poppet valve rather than some other valve structure.

When the needle control chamber 37 is fluidly connected to the injector line 16, pressurized fuel is acting on the closing hydraulic surface 36 of the needle valve member 38. Thus, the pressurized fuel in the nozzle supply passage 42 acting on the opening hydraulic surface 35 of the needle valve member 38 is insufficient to lift the needle valve member 38 against the bias of the spring 39 and open the nozzle outlets 26 for injection. When the needle control chamber 37 is fluidly connected to the low pressure drain 24 via the low pressure passage 40, the pressure in the nozzle supply passage 42 acting on the opening hydraulic surface 35 of the needle valve member 38 is sufficient to lift the needle valve member 38 against the bias of the spring 39 and open the nozzle outlets 26 for injection.

INDUSTRIAL APPLICABILITY

Referring to FIG. 1, a method of accommodating a fuel injector spatial envelope for the fuel injector 14 will be discussed. Although the operation of the present disclosure will be discussed for only fuel injector 14 associated with flow control valve 18, it should be appreciated that the present disclosure operates similarly for each fuel injector and flow control valve within the engine 10. Moreover, it should be appreciated that the present disclosure contemplates use with any fuel injector with a pressure intensifier that is actuated by fuel, and can inject fuel at a rail pressure and an intensified pressure.

In order to accommodate the fuel injector spatial envelope, the pressure intensifier 15 and the nozzle outlets 26 of the fuel injector 14 are fluidly connected to the pressurized fuel common rail 13 via the intensifier line 17 and the injector line 16, respectively. Further, the flow of fuel to the pressure intensifier 15 is controlled by the flow control valve 18 that is attached to the pressurized fuel common rail 13. Because the flow control valve 18 is separate from the fuel injector 14, the fuel injector 14 is smaller and can more easily fit within the fuel injector spatial envelope adjacent to the engine cylinder 41.

The fact that the flow control valve 18 is not attached to the fuel injector 14 does not compromise the fuel injector's capability to vary the pressure of the injections. If an injection at rail pressure is desired, the first electrical actuator 22 attached to the flow control valve 18 will not be activated. Thus, the flow control valve member 19 will remain in its biased position, connecting the pressure intensifier 15 to the low pressure drain 24. The fuel flowing from the common rail 13 into the nozzle supply passage 42 via the injector line 16 will not be further pressurized by the pressure intensifier 15, but rather will remain at rail pressure. When the direct control needle valve 28 opens the nozzle supply passage 42, the rail pressure fuel can flow through the nozzle outlets 26 and into the engine cylinder 41.

If an injection at an intensified pressure is desired, an electronic control module (not shown) will activate the first electrical actuator 22, causing the valve member 19 to move to its first position against the bias of the spring 21. In addition to the fuel flowing from the common rail 13 to the fuel pressurization chamber 31 via the injector line 16, the fuel can also flow from the pressurized fuel common rail 13 to the pressure intensifier 15 via the intensifier line 17. The pressurized fuel acting on the piston hydraulic surface 34 will cause the intensifier piston 32 and plunger 33 to advance and pressurize the fuel within the pressurization chamber 31. The advancing plunger 33 will cause the intensified pressure fuel to flow from the fuel pressurization chamber 31 and to the nozzle supply passage 42 where the fuel will act on the opening hydraulic surface 35 of the direct needle valve member 38. The check valve 30 will block the flow of fuel back to the common rail 13 via the injector line 16. When the direct control needle valve 28 opens the nozzle supply passage 42, the intensified pressure fuel can flow through the nozzle outlets 26 and into the engine cylinder 41.

Regardless of whether the fuel within the nozzle supply passage 42 is at rail pressure or the intensified pressure, the timing and duration of the injection event can be controlled by the actuation of the needle control valve 27. When an injection event is desired, the electronic control module (not shown) will activate the second electrical actuator 29, thus, causing the needle control valve 27 to fluidly connect the needle control chamber 37 to the low pressure drain 24 via the low pressure passage 40. Thus, the pressure within the nozzle supply passage 42 acting on the opening hydraulic surface 35, regardless of whether the fuel is at rail pressure or the intensified pressure, is sufficient to move the needle valve member 38 against the bias of the spring 39 and the low pressure and open the nozzle outlets 26 for fuel injection into the cylinder 41. In order to end the injection event, the electronic control module will de-activate the second electrical actuator 29, causing the needle control valve 27 to fluidly connect the needle control chamber 37 to the nozzle supply passage 42. The pressurized fuel acting on the closing hydraulic surface 36 of the needle valve member 38 and the bias of the spring 39 will be sufficient to overcome the fuel pressure acting on the opening hydraulic surface 35 and close the direct control needle valve 28.

The present disclosure is advantageous because it provides a multi-capability fuel injector 14 that can fit within the fuel injector spatial envelope adjacent and within the cylinder head without compromising the performance capabilities of the fuel injector. Those skilled in the art will appreciate that fuel injectors that include pressure intensifiers actuated by fuel are generally larger than oil-actuated fuel injectors in order to compensate for higher sealing pressures and the flow of the pressurized fuel through the injector body and associated valves. Despite the increased size of the fuel injector 14, by separating the flow control valve 18 from the fuel-actuated fuel injector 14, the fuel-actuated fuel injector 14 can fit within the fuel injector spatial envelope above and within the cylinder head. Further, by separating the flow control valve 18 from the fuel injector 14, there is room within the fuel injector spatial envelope to include components, such as the needle control valve 27 and the direct control needle valve 28, that increase the control over the fuel injection. The valves 27 and 28, along with the pressure intensifier 15, provide a greater variety of fuel injection strategies available to the fuel injection system 12, which can lead to a reduction in emissions. Similarly, there is space for electrical actuators that may have been too large to fit within the cylinder head to be attached to the flow control valve 18 mounted on the common rail 13.

Further, because the flow control valve 18 is attached to the pressurized fuel common rail 13, the need for fuel conduits, connections and couplers, between the flow control valve 18 and common rail 13 is eliminated. Less connections can reduce expense and the likelihood of leakage.

It should be understood that the above description is intended for illustrative purposes only, and is not intended to limit the scope of the present disclosure in any way. For instance, the respective injector line 16 and intensifier line 17 may be connected to separate common rails at different pressures to produce an even wider array of capabilities. Thus, those skilled in the art will appreciate that other aspects, objects, and advantages of the disclosure can be obtained from a study of the drawings, the disclosure and the appended claims.

What is claimed is:

1. A fuel injection system comprising:

at least one fuel source;

a fuel injector including a pressure intensifier positioned in an injector body fluidly connected to the at least one fuel source via an injector line and a separate intensifier line;

a valve including a moveable valve member within a valve body being attached to the at least one source of fuel, but the valve body being separated from injector body by a segment of the intensifier line located outside the valve body and the injector body, and when the valve member is in a first position, the intensifier line is open to the fuel source, and when the valve member is in a second position, the intensifier line is blocked from the fuel source; and wherein a separation between the injector body and the valve body is sufficiently large that the fuel injector can fit in a limited spatial envelope adjacent and within a cylinder head.

2. The fuel injection system of claim 1 wherein the fuel injector being one of a plurality of fuel injectors, and the valve being one of a plurality of valves; and the at least one fuel source being a pressurized fuel common rail.

3. The fuel injection system of claim 1 wherein the valve being a three-way valve operably coupled to a first electrical actuator; and when the valve member is in the first position, the intensifier line is blocked from a low pressure drain, and when the valve member is in the second position, the intensifier line is open to the low pressure drain.

4. The fuel injection system of claim 1 wherein the fuel injector assembly includes a direct control needle valve including a moveable member with a closing hydraulic surface exposed to pressure within a needle control chamber; and a needle control valve being operable, in a first position, to raise the pressure within the needle control chamber, and being operable, in a second position, to lower the pressure within the needle control chamber.

5. The fuel injection system of claim 4 wherein the fuel injector being one of a plurality of fuel injectors and the valve being one of a plurality of valves;

at least one fuel source being a pressurized fuel common rail; and each valve being a three-way valve operably coupled to a first electrical actuator, and when the valve member is in the first position, the intensifier line is blocked from a low pressure drain, and when the valve member is in the second position, the intensifier line is open to the low pressure drain.

6. An engine comprising:

an engine housing that includes a cylinder head; and a fuel injection system attached to the engine housing, and including at least one fuel source being fluidly connectable to a fuel injector including a pressure intensifier via a an injector line and an intensifier line, and a valve including a moveable valve member within a valve body being attached to the at least one fuel source, but the valve body being separated from the injector body by a segment of the intensifier line located outside the valve body and the injector body, and when the valve member is in a first position, the intensifier line is open to the fuel source, and when the valve member is in a second position, the intensifier line is blocked from the fuel source; and wherein a separation between the injector body and the valve body is sufficiently large that the fuel injector can fit in a limited spatial envelope adjacent and within the cylinder head.

7. The engine of claim 6 wherein the fuel injector being one of a plurality of fuel injectors and the valve being one of a plurality of valves; and the at least one fuel source being including a pressurized fuel common rail.

8. The engine of claim 6 wherein the valve being a poppet valve operably coupled to a first electrical actuator; and when the valve member is in the first position, the intensifier line is blocked from a low pressure drain, and when the valve member is in the second position, the intensifier line is open to the low pressure drain.

9. The engine of claim 6 wherein the fuel injector assembly includes a direct control needle valve including a moveable member with a closing hydraulic surface exposed to pressure within a needle control chamber; and a needle control valve being operable, in a first position, to raise the pressure within the needle control chamber, and being operable, in a second position, to lower the pressure within the needle control chamber.

10. The engine of claim 9 wherein the fuel injector being one of a plurality of fuel injectors and the valve being one of a plurality of valves;

the at least one fuel source being a pressurized fuel common rail; and each valve being a three-way valve operably coupled to a first electrical actuator, and when the valve member is in the first and second positions, the intensifier line is blocked from a low pressure drain, and when the valve member is in a third position, the intensifier line is open to the low pressure drain.

11. A method of accommodating a limited fuel injector spatial envelope for a fuel injector with a direct control needle valve and being operable to inject fuel at a rail pressure and an intensified pressure, comprising the steps of:

fluidly connecting a pressure intensifier and a nozzle outlet of the fuel injector to at least one source of fuel via an intensifier line and an injector line, respectively; and controlling the flow of fuel to the pressure intensifier via a valve attached to at least one source of fuel; and separating the fuel injector from the valve by a sufficiently long segment of the intensifier line that the fuel injector can fit into a limited spatial envelope adjacent and within a cylinder head.

* * * * *